US006442959B1

(12) United States Patent
Sone

(10) Patent No.: US 6,442,959 B1
(45) Date of Patent: Sep. 3, 2002

(54) THERMOSIPHON FOR REFRIGERATING MACHINE

(75) Inventor: Kazuya Sone, Niigataken (JP)

(73) Assignee: Twinbird Corporation (JP)

( * ) Notice: Subject to any disclaimer, the term of this patent is extended or adjusted under 35 U.S.C. 154(b) by 0 days.

(21) Appl. No.: 09/894,543

(22) Filed: Jun. 28, 2001

(30) Foreign Application Priority Data

Jun. 28, 2000 (JP) ..... 2000-195258

(51) Int. Cl.[7] ..... F25D 17/00; F25D 17/02; F25B 9/00; F28D 15/00

(52) U.S. Cl. ..... 62/333; 62/6; 62/99; 165/104.21

(58) Field of Search ..... 62/333, 99, 6, 62/334; 165/104.21

(56) References Cited

U.S. PATENT DOCUMENTS

| | | | | | |
|---|---|---|---|---|---|
| 2,297,071 | A | * | 9/1942 | Prentice | 165/104.21 |
| 2,330,916 | A | | 10/1943 | Philipp | |
| 2,405,392 | A | | 8/1946 | Atchison | |
| 2,479,848 | A | * | 8/1949 | Mackey et al. | 62/333 |
| 2,889,686 | A | * | 6/1959 | Kohler | 62/6 |
| 3,756,903 | A | * | 9/1973 | Jones | 165/104.21 |
| 5,190,098 | A | * | 3/1993 | Long | 165/104.22 |
| 5,735,131 | A | * | 4/1998 | Lambright et al. | 62/99 |
| 5,953,930 | A | * | 9/1999 | Chu et al. | 62/259.2 |
| 6,112,526 | A | * | 9/2000 | Chase | 62/6 |
| 6,272,867 | B1 | * | 8/2001 | Barrash et al. | 62/6 |

FOREIGN PATENT DOCUMENTS

| | | |
|---|---|---|
| DE | 134118 | 10/1902 |
| EP | 0454491 | 3/1991 |
| JP | 8-14776 | 1/1996 |
| JP | 08005170 | 1/1996 |
| JP | 9-273876 | 10/1997 |
| JP | 10-227587 | 8/1998 |

* cited by examiner

*Primary Examiner*—William C. Doerrler
(74) *Attorney, Agent, or Firm*—Akerman Senterfitt

(57) ABSTRACT

A thermosiphon for a refrigerating machine which can maintain smooth circulation of working fluid by ensuring the flow of the working fluid into a condenser even if it is condensed in a connecting end of a gas pipe connected to the condenser. The gas pipe 16 connected to the condenser 12 has a connecting end which is formed with a riser pipe 28, thereby constructing a reverse-flow suppressing portion 30 which is brought to a higher position than the condenser 12. Thus, even if the working fluid is condensed in the riser pipe 28, the condensed working fluid can be forcedly allowed to flow down into the condenser 12 by gravitational force.

8 Claims, 3 Drawing Sheets

THERMOSIPHON FOR REFRIGERATING MACHINE

BACKGROUND OF THE INVENTION a) Field of the Invention

The present invention relates to a thermosiphon for transferring cooling energy from a refrigerating machine to a portion to be cooled.

b) Prior Art

Conventional thermosiphon of this type comprises a closed fluid system in which is enclosed a working fluid, said closed fluid system being constructed of a condenser, a liquid pipe connected to the condenser, an evaporator connected to the liquid pipe, and a gas pipe which is connected to the evaporator and returns to said condenser. In such conventional thermosiphon, the working fluid is deprived of heat at the condenser attached to a refrigerating machine so that the fluid is condensed, and then the fluid thus condensed flows down through the liquid pipe to reach the evaporator, where the working fluid deprives a portion to be cooled of latent heat of evaporation, so that it is evaporated to thereby go up through the gas pipe until it reaches the condenser. This cycle is operated by the difference in liquid level between the working fluid flowing down through the liquid pipe and the working fluid in the gas pipe.

According to such conventional thermosiphon, however, cooling energy from the refrigerating machine is liable to cool not only the condenser but also the respective connecting ends of the gas pipe and the liquid pipe, and thus the working fluid is condensed not only in the condenser but also in the liquid pipe and the upper portion of the gas pipe. In the liquid pipe, the working fluid is little condensed, as it is already almost condensed in the condenser. In the gas pipe, however, the condensed working fluid flows back and returns to the evaporator, and thus the amount of the working fluid that is to be condensed in the condenser and then to flow down through the liquid pipe is liable to be decreased by that amount. As a result, the liquid level in the liquid pipe is likely to be lowered, while that in the gas pipe is likely to be raised.

Further, as the liquid pipe is formed thinner than the gas pipe, the condensed working fluid is likely to overflow from the condenser so that it flows backward from the gas pipe to the evaporator, in the event that the condenser is overcooled for some reason. As above mentioned, the circulation fluid system of the working fluid is operated by the difference in liquid level between the working fluid flowing down the liquid pipe and the working fluid in the gas pipe. Accordingly, small difference in liquid level provides an obstruction to the above fluid system, and thus the circulation efficiency is likely to be lowered. Furthermore, there is another problem that vibration from the refrigerating machine is likely to be transferred to the evaporator, even to an object to be cooled, via the gas pipe or the liquid pipe, to thereby adversely affect the object. As the gas pipe is formed thicker than the liquid pipe, more vibration from the refrigerating machine is transferred to the evaporator via the gas pipe than via the liquid pipe.

SUMMARY OF THE INVENTION

Accordingly, it is a main object of the present invention to provide a thermosiphon for refrigerating machine which can cool something without the circulation system of the working fluid being choked.

It is another object of the present invention to provide a thermosiphon for refrigerating machine which can transfer the least possible vibration from the refrigerating machine to a portion to be cooled.

To attain the above objects, there is provided a thermosiphon for refrigerating machine, in accordance with a first aspect of the invention, comprising: a condenser provided in a cooling portion of the refrigerating machine, a liquid pipe connected to the condenser; an evaporator connected to the liquid pipe for depriving an object of heat; a gas pipe connected to the evaporator, said gas pipe extending back to said condenser; a working fluid which is filled in a circulation fluid system defined by said condenser, liquid pipe, evaporator and gas pipe; and a reverse-flow suppressing portion formed in a part of the gas pipe in the vicinity of said condenser, said reverse-flow suppressing portion including a riser pipe, positioned in a higher position than said condenser.

Thus, even if the working fluid is condensed in the reverse-flow suppressing portion due to the cooling energy from the condenser being transferred thereto, the condensed working fluid can be prevented from flowing back through the gas pipe into the evaporator, as the reverse-flow suppressing portion is provided in a higher position than the condenser, thereby ensuring the flowing down of the working fluid into the condenser. Further, as the distance from the condenser that is in contact with the refrigerating machine and the evaporator is elongated due to the reverse-flow suppressing portion being provided, the vibration transferred from the refrigerating machine to the evaporator is decreased by that elongated distance.

Further, there is also provided a thermosiphon for refrigerating machine from another aspect of the invention, wherein the thermosiphon according to the first aspect of the invention further comprises a damper portion which is formed by bending said gas pipe and/or said liquid pipe into the form of a wave or a coil.

Thus, the liquid pipe and/or the gas pipe is elongated by providing such damper portion, which in turn means that the distance from the condenser that is in contact with the refrigerating machine and the evaporator is elongated, thereby decreasing the vibration transferred from the refrigerating machine to the evaporator.

Furthermore, there is also provided a thermosiphon for refrigerating machine from a further aspect of the invention, wherein the gas pipe provided at a top side is always higher or at least even with said evaporator in said fluid passage. Accordingly, even though the liquid pipe and/or the gas pipe are/is formed with the waveform-shaped damper portion, yet the top side of the gas pipe is higher, or at least even with the evaporator so that the flowing-down of the condensed working fluid into the evaporator is insured, without staying in the course of the damper portion.

BRIEF DESCRIPTION OF THE DRAWINGS

Other objects, features and advantages of the invention will be apparent to those skilled in the art from the following description of the preferred embodiments of the invention, wherein reference is made to the accompanying drawings, of which.

DESCRIPTION OF PREFERRED EMBODIMENTS

Figure 1:
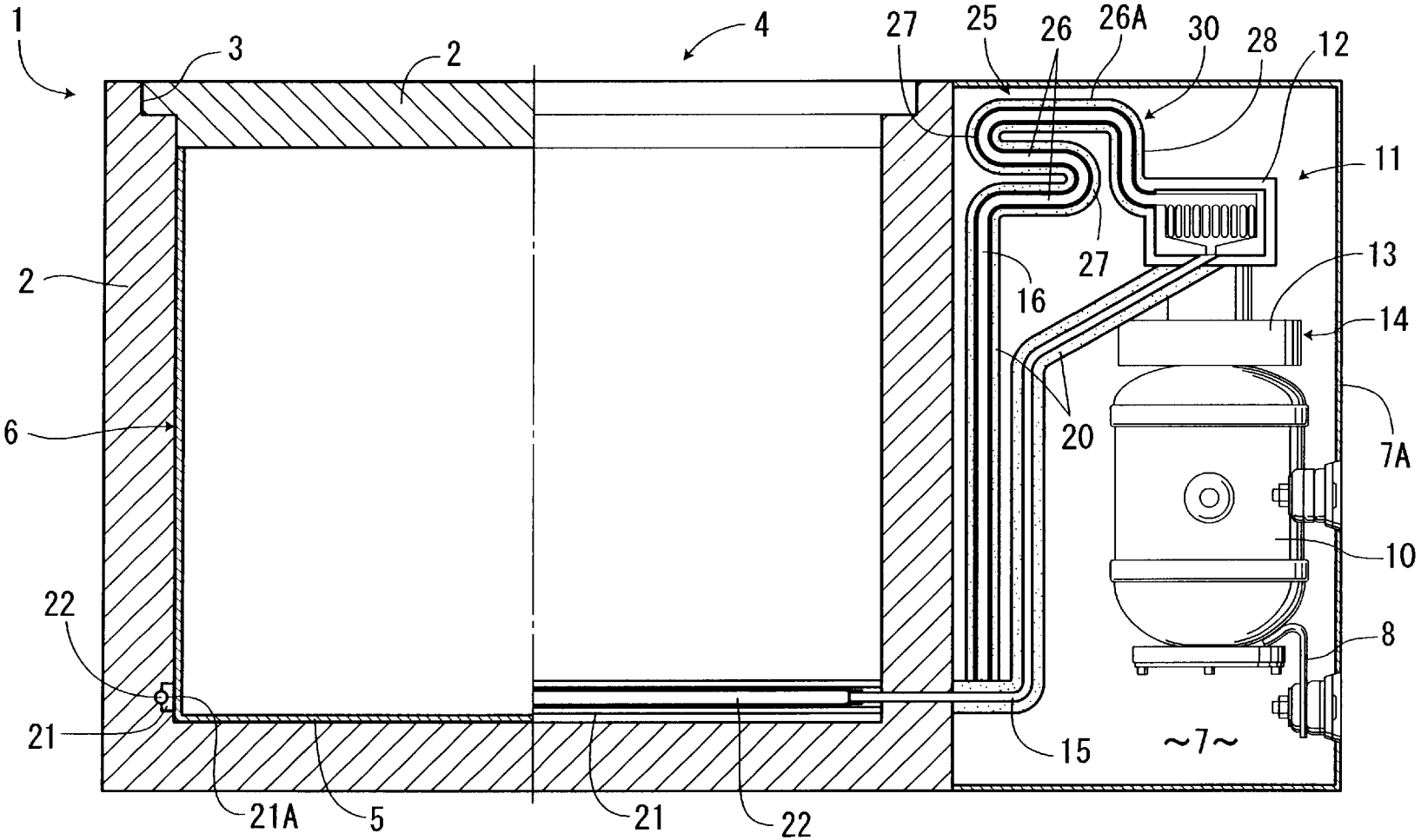
FIG. 1 is a section of a refrigerator in accordance with an embodiment of the invention.
Figure 2:
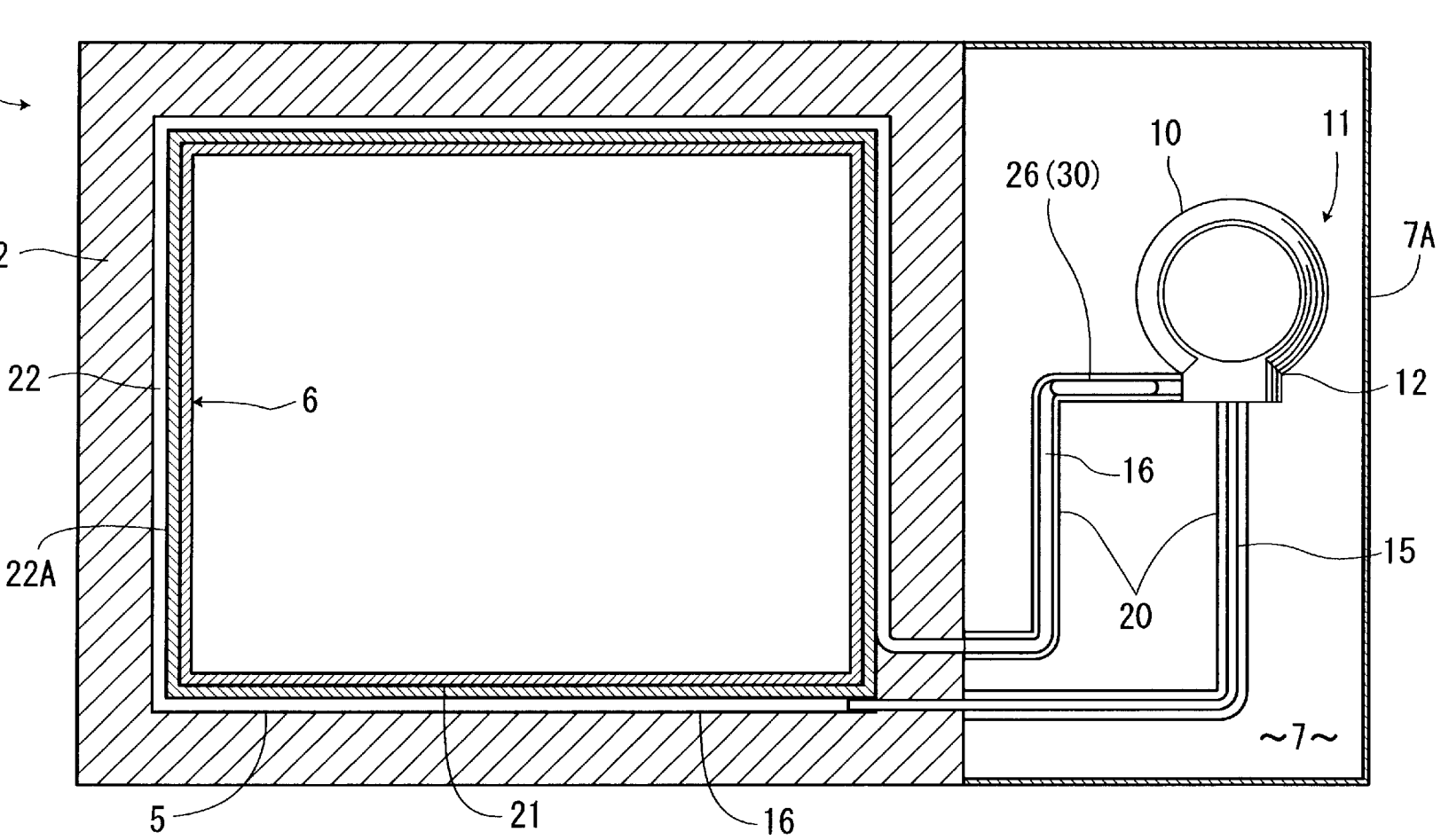
FIG. 2 is a plan view showing the refrigerator of FIG. 1.

Hereinafter is described a preferred embodiment of the present invention with reference to FIGS. 1 and 2, in which a thermosiphon of the invention is illustrated as the one for use as a portable refrigerator/freezer. In FIG. 1, reference numeral 1 designates a heat-insulating casing made of a heat-insulating material 2, having an opening 3 provided with a closable lid 4 made of the heat-insulating material 2. Into the inside surface of the heat-insulating casing 1 is incorporated an evaporating portion or evaporator 6 which is constructed of an aluminum container 5 with good heat conductance, a heat transferring member 21 fixed to the outer surface of the container 5 in close contact therewith, said member 21 being formed with a groove 21A, and an evaporating pipe 22 attached to the groove 21A. The evaporating pipe 22 is thermally conductively connected to the aluminum container 5 across the heat-transferring member 21. A first side of the heat-insulating casing 1 is formed with a cooling chamber 7, having a side plate 7A, while a refrigerating machine or stirling cooler 10 is mounted to the side plate 7A by a fixing bracket 8. The stirling cooler 10 has a heat absorbing portion 11 connected to a condenser 12, while it has a heat dissipating portion 14 connected to a radiator 13. Thus, the condenser 12 and the aforesaid evaporator 6 are connected to each other so that a closed fluid system may be provided. In other words, a liquid pipe 15 connected to the condenser 12 is connected to the evaporator 6, while a gas pipe 16 connected to the evaporator 6 is connected to the condenser 12. This way, the condenser 12 is connected to the liquid pipe 15, which is connected to the evaporator 6, which is then connected to the gas pipe 16, which is finally connected to the condenser 12 to thereby construct a natural circulation thermosiphon in which the working fluid filled in the closed fluid system is allowed to naturally circulate therein.

The aforesaid liquid pipe 15 and the gas pipe 16 are each formed from a material having excellent tensile strength and workability, such as copper pipe, each pipe having its periphery covered with a heat-insulating material 20 inside said cooling chamber 7. For the liquid pipe 15 is used a comparatively thin pipe material so that it may define a small cross-sectional area, while for the gas pipe 16 is used a comparatively thick pipe material so that it may define a large cross-sectional area. The liquid pipe 15, which extends downwardly from the condenser 12, penetrates through the heat-insulating material 2 that constructs a first side of the heat-insulating casing 1, to thereby reach the evaporator 6. More specifically, the liquid pipe 15 is connected to one end of the evaporating pipe 22 which is formed from a thick copper pipe and attached to the outer peripheral surface of the aluminum container 5. On the other hand, the other end of the evaporating pipe 22 is allowed to penetrate through the heat-insulating material 2 that constructs the first side of the heat-insulating casing 1 to thereby connect to the gas pipe 16, which is then connected to the condenser 12, thus constructing a closed fluid system. Also, the gas pipe 16 inside the cooling chamber 7 extends vertically upwardly from a bottom side of the heat-insulating casing 1, forming a damper portion 25 at a top side of the cooling chamber 7, then reaching the condenser 12.

The damper portion 25 is formed by bending the gas pipe 16 into a wave form, comprising a plurality of horizontal portions 26 arranged in parallel, and semi-arc-shaped, curved portions 27 for connecting the horizontal portions to each other. The uppermost horizontal portion 26A has an end from which curvedly extends a riser pipe 28 which connects to said condenser 12. In other words, the gas pipe 16 connected to the condenser 12 comprises the riser pipe 28 which extends vertically immediately before the condenser 12 such that the riser pipe 28 constructs a reverse-flow suppressing portion 30 positioned higher than the condenser 12.

Next, the action of the invention is described hereinafter.

The working fluid is deprived of heat of condensation in the condenser 12 which is thermally connected to the heat absorbing portion 11 of the stirling cooler 10, so that the working fluid thus condensed flows down through the liquid pipe 15 by gravity to reach the evaporator 6. In the evaporator 6, the working fluid deprives the aluminum container 5 that constructs a part of the evaporator 6 of latent heat of evaporation, so that it is evaporated, thereby cooling the heat-insulating casing 1. The working fluid evaporated in the evaporator 6 goes up through the gas pipe 16 to return to the condenser 12, thereby constructing a cooling cycle.

As above discussed, this cycle is actuated by the difference in liquid level of the working fluid between when it flows down through the liquid pipe 15 and when it is in the gas pipe 16. As a thin copper pipe of small cross-sectional area is used as the liquid pipe 15, even a small amount of the working fluid which is in liquid state causes such a high liquid level that it becomes comparatively easy to obtain a force for circulating the working fluid. On the other hand, as the working fluid which is evaporated in the evaporator 6 flows through the gas pipe 16 made from a thick copper pipe of a large cross-sectional area, the gas is subjected to less resistance in flowing therethrough. Further, as the gas pipe 16 is brought to a higher position than the condenser 12 by the riser pipe 28 extending vertically immediately before the condenser 12, the reverse-flow suppressing portion 30 can be constructed by the riser pipe 28, thus preventing the reverse-flowing of the condensed working fluid.

In other words, the gas pipe 16 and the liquid pipe 15 are each connected to the condenser 12 which is cooled by the stirling cooler 10, and thus the cooling energy from the condenser 12 cools not only the liquid pipe 15 but also the connecting end of the gas pipe 16, so that the working fluid is condensed in the connecting end of the gas pipe 16 as well. However, due to the riser pipe 28 formed at the connecting end of the gas pipe 16, the upper end of the riser pipe 28 can be brought to a higher position than the condenser 12. Thus, even though the working fluid is condensed in the riser pipe 28, it is possible to forcedly make such condensed working fluid flow down into the condenser 12 by the gravitational Accordingly, owing to the reverse-flow suppressing portion 30 constructed by the riser pipe 28, the reverse-flowing of the condensed working fluid can be prevented, thus preventing the drop in efficiency when circulating the working fluid.

Furthermore, it should be noted that in the fluid passage extending from the horizontal portion 26A to the evaporator 6 via the condenser 12 and the liquid pipe 15, the horizontal portion 26A is always positioned in a higher point than the evaporator 6, while in the fluid passage extending from the evaporator 6 to the horizontal portion 26A via the gas pipe 16, the evaporator 6 is always positioned in a lower or at least even point relative to the horizontal portion 26A, as illustrated in FIG. 1. Accordingly, even though the working fluid is condensed by keeping apparatus in a place of low temperature, it is prevented from staying anywhere in the fluid circulation circuit, whereby the circulation is not hindered if the apparatus is actuated. Further, due to the riser pipe 28 serving as the reverse-flow suppressing portion 30 provided at the connecting end of the condenser 12, the distance between the condenser 12 in contact with the stirling cooler 10 and the evaporator 6 is elongated, so that the vibration transferred from the stirling cooler 10 to the evaporator 6 is damped. Additionally, to the riser pipe 28 is connected the damper portion 25 of the gas pipe 16, which is bent into a wave form so that the distance from the condenser 12 to the evaporator 6 is elongated, whereby the vibration from the Stirling cooler 10 to the evaporator 6 is further decreased.

The reason why the damper portion 25 is formed in the gas pipe 16 in the foregoing embodiment is that the vibration from the stirling cooler 10 is more likely to transfer to the gas pipe 16 due to the thick copper pipe being used as the gas pipe 16. Therefore, where to form the damper portion 25 should not be restricted, but may be other portions, such as in the liquid pipe 15, or both in the gas pipe 16 and in the liquid pipe 15. It should be noted that what is important is to form the damper portion 25 between the vibration generating stirling cooler 10 and the heat-insulating casing 1 that actually cools something.

Figure 3:
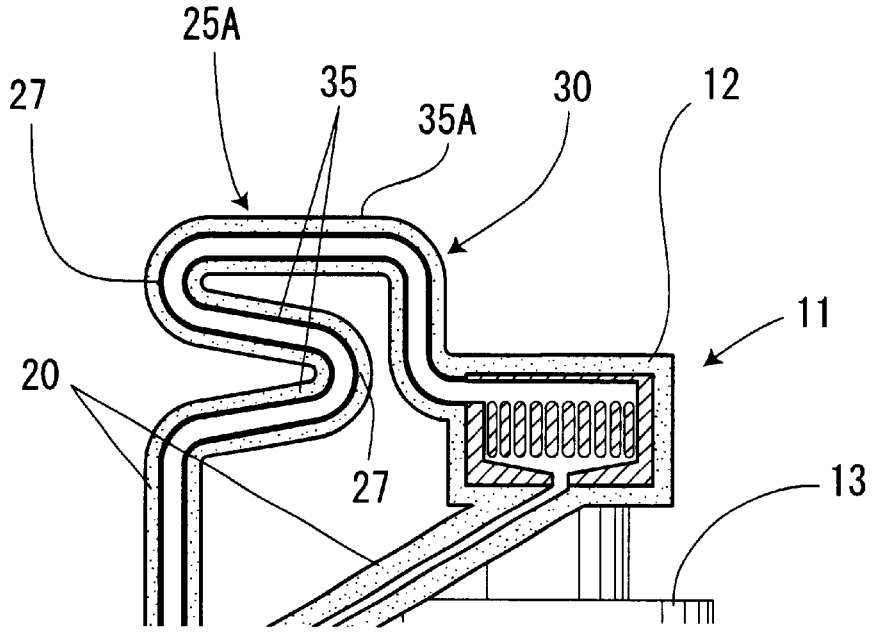
FIG. 3 is a front view showing a modified example of a damper portion of the refrigerator of FIG. 1.

Although the damper portion 25 is formed into a wave form, comprising plural horizontal portions 26 arranged in parallel and semi-arc-shaped, curved portions 27 for linking them each other in the foregoing embodiment as shown in FIG. 1, another modified example as illustrated in FIG.3 may be employed for the present invention, in which plural straight portions 35 are linked to each other by the curved portions 27 such that the straight portions 35 extend obliquely upwardly, thus constructing a damper portion 25A arranged into a wave form as a whole.

As above described, the damper portion 25 or 25A for decreasing the vibration from the Stirling cooler 10 may be provided in at least one of the liquid pipe 15 and the gas pipe 16. Also, the damper portion 25 or 25A may comprise the horizontal portions 26 or straight portions 35 which extend obliquely toward the uppermost horizontal portion 26A or 35A. As such, even though the liquid pipe 15 and/or the gas pipe 16 are formed with the waveform-shaped damper portion 25, yet the top side of the gas pipe 16 is higher, or at least even with the evaporator 6, so that the flowing-down of the condensed working fluid into the evaporator 6 is insured, without staying in the course of the damper portion 25.

Incidentally, the present invention should not be limited to the foregoing embodiments, but may be modified within the scope of the invention. For example, although the Stirling cooler is used as a refrigerating machine in the foregoing embodiments, a Peltier element or a compressor may be used therefor. Further, although the riser pipe extending vertically is proposed to serve as the reverse-flow suppressing portion in the foregoing embodiments, it may extend obliquely. Alternatively, the riser pipe may be formed at its lower end with a horizontal pipe, which may be then connected with the condenser. It should be noted that what is important is to provide the connecting end of the gas pipe with a reverse-flow suppressing portion by means of the riser pipe which is positioned higher than the condenser. Alternatively, the damper portion may be configured into a suitable form other than the waveform, such as the form of a coil. It should be noted that the thermosiphon for refrigerating machine in accordance with the invention may be used not only for a portable refrigerator/freezer, but also for a variety of other types of machines and apparatus. Although the reverse-flow suppressing portion is used as damper portion in the foregoing embodiment, they may be provided separately.

What is claimed:

1. A thermosiphon for a refrigerating machine comprising:

a condenser;

a liquid pipe connected to the condenser;

an evaporator connected to the liquid pipe;

a gas pipe connected to the evaporator and to the condenser:

a working fluid provided in a fluid path defined by said condenser, liquid piper evaporator and gas pipe; and a reverse-flow suppressing portion formed in a part of the gas pipe in the vicinity of said condenser, said reverse-flow suppressing portion including a riser pipe positioned above said condenser, wherein a damper portion is formed in the gas pipe by banding the gas pipe into a waveform or coil so that a portion of the gas pipe is higher than or at least even with the evaporator; and wherein said riser pipe extends from an uppermost end of the damper portion to the condenser so that the damper portion includes the riser pipe as a part thereof.

2. A thermosiphon for a refrigerating machine according to claim 1, wherein said riser pipe is straight and extends vertically.

3. A thermosiphon for a refrigerating machine according to claim 1, wherein said liquid pipe is formed from a copper pipe defining a relatively small cross-sectional area; and wherein said gas pipe is formed from a copper pipe defining a relatively large cross-sectional area.

4. A thermosiphon for a refrigerating machine according to claim 1, wherein said damper portion is formed by banding said gas pipe so that it comprises:

a plurality of horizontal portions arranged in parallel:

curved portions for connecting the horizontal portions to each other; and said riser pipe, which is bent from an end of the uppermost one of said horizontal portions, extending to connect to said condenser.

5. A thermosiphon for a refrigerating machine according to claim 1, wherein said damper portion is formed by bending said gas pipe so that it comprises:

a plurality of straight portions which extend obliquely upwardly;

curved portions for connecting the straight portions to each other so as to arrange said straight portions in a waveform as a whole; and said riser pipe, which is bent from an end of the uppermost one of said straight portions, extending to connect to said condenser.

6. A thermosiphon for a refrigerating machine according to claim 1, wherein said evaporator comprises: a container made of a material of good heat conductance; a heat transferring member fixed to an outer surface of the container in close contact therewith; and an evaporating pipe attached to the heat transferring member.

7. A thermosiphon for a refrigerating machine according to claim 6, wherein said container is covered with a heat insulating material, comprising a lid for opening or closing an opening of the container, while a cooling chamber is provided adjacent to the container to include said refrigerating machine thereinside.

8. A thermosiphon for a refrigerating machine according to claim 7, wherein said refrigerating machine is a stirling cooler.

* * * * *

UNITED STATES PATENT AND TRADEMARK OFFICE

CERTIFICATE OF CORRECTION

PATENT NO. : 6,442,959 B1
DATED : September 3, 2002
INVENTOR(S) : Sone

It is certified that error appears in the above-identified patent and that said Letters Patent is hereby corrected as shown below:

Column 4,
Line 42, replace “gravitational Accordingly” with -- gravitational force. Accordingly --.

Column 5,
Lines 2, 27 and 41, replace “Stirling” with -- stirling --.

Column 6,
Line 8, replace “piper” with -- pipe, --.
Line 14, replace “banding” with -- bending --.

Signed and Sealed this

First Day of July, 2003

JAMES E. ROGAN
*Director of the United States Patent and Trademark Office*